US006929612B2

(12) United States Patent
Mangano

(10) Patent No.: US 6,929,612 B2
(45) Date of Patent: Aug. 16, 2005

(54) BATTERY OPERATED FLEXIBLE MASSAGE TUBE

(75) Inventor: Joy Mangano, St. James, NY (US)

(73) Assignee: Ingenious Designs LLC, Edgewood, NY (US)

( * ) Notice: Subject to any disclaimer, the term of this patent is extended or adjusted under 35 U.S.C. 154(b) by 0 days.

(21) Appl. No.: 10/607,385

(22) Filed: Jun. 26, 2003

(65) Prior Publication Data

US 2004/0267173 A1 Dec. 30, 2004

(51) Int. Cl.[7] ..... A61H 11/00
(52) U.S. Cl. ..... 601/71; 601/72
(58) Field of Search ..... 601/46, 48, 49–54, 601/56–60, 61, 67–70, 78, 80, 81; 602/18

(56) References Cited

U.S. PATENT DOCUMENTS 750,735 A * 1/1904 Turck ..... 601/72
4,428,368 A * 1/1984 Torii
4,872,229 A * 10/1989 Brady ..... 5/710
4,878,489 A * 11/1989 Kamayachi ..... 601/72
4,935,972 A * 6/1990 Brady ..... 4/575.1
4,958,628 A * 9/1990 Iwamoto et al.
5,167,227 A * 12/1992 Meserlian
5,193,528 A * 3/1993 Iwamoto et al.
5,344,437 A * 9/1994 Pistay ..... 607/109
5,374,238 A * 12/1994 Xiao ..... 601/57
5,609,566 A * 3/1997 Pupovic
5,736,213 A * 4/1998 Meier ..... 428/76
6,332,873 B1 * 12/2001 Naruse et al.
6,764,214 B2 * 7/2004 Shukla et al. ..... 366/214
2002/0169398 A1 * 11/2002 Hancock ..... 601/15

* cited by examiner

*Primary Examiner*—Michael A. Brown
(74) *Attorney, Agent, or Firm*—Galgano & Burke, LLP

(57) ABSTRACT

A battery operated flexible massage device includes a ball-and-socket modular plastic spine and an electric vibrator unit, covered by a flexible foam tube. The tube containing the spine and the vibrator unit is covered with a padded fabric cylindrical shell. The ends of the shell are provided with zippers which allow access to battery compartments. According to the presently preferred embodiment, the vibrator unit is centrally located adjacent to the flexible plastic spine. Two battery compartments are provided, one at each end of the tube, each for containing two AA batteries. A control switch is mounted adjacent to one of the battery compartments.

14 Claims, 6 Drawing Sheets

BATTERY OPERATED FLEXIBLE MASSAGE TUBE

BACKGROUND OF THE INVENTION

1. Field of the Invention

The invention relates to electrically operated massage devices. More particularly, the invention relates to a flexible, battery operated massage tube.

2. Brief Description of the Prior Art

Conventional electrically operated massage units may be divided into the following three types:

(1) relatively compact, lightweight hand held massage units which contain a vibrator and which may be manually placed on the desired area of the body such as shoulder, waist, leg, arm, etc.;

(2) larger dimension units which consist of a massage block made of a movable pushing material mounted on the backrest of a chair, for example, whereby the neck, shoulder and back of the user are all massaged;

(3) large-scale massage units which contain a massage block provided with a freely movable roller on a mattress or a bed piece so that the user lays down on it, facing upward, and is massaged by the unit.

The conventional compact type massage unit as described above is usually short in length, and the user often feels fatigue on his or her hand and arm when holding the massage unit because the vibrator piece must be directly applied on the desired area of the user's body. In particular, it is difficult to turn the hand and arm to apply the unit to the shoulder, back, etc. or to perform massage for long time because it requires an unnatural posture, and the user often needs help from another person. There have been only a few types of massage units which permit the user to perform massage while he or she continues to do office work, cooking or studying at a table or desk. In the large-scale massage unit of backrest type or upward facing type as described above, the unit is expensive, requires considerable space, and requires that the user sit back and refrain from moving.

U.S. Pat. No. 4,878,489 to Kamayachi discloses a massage unit which contains a vibrator within a flexible long cylindrical piece. The user can hold both ends of the unit and apply it freely to any desired area of the body. The unit can rest on the affected area and the user can continue office work, cooking, etc. while enjoying the effects of massage. In one embodiment the massage unit can be bent to any desired shape, which shape is retained by a plastically deformable metal wire, such that the user can apply the bent massage unit around any part of the body without having to continue holding the massage unit.

While the Kamayachi device may be satisfactory in use, it has several disadvantages. It has a rather complicated design, its wire spine is subject to fatigue and possible fracture as a result of repeated bending and the range of motion using a metal wire core would also appear limiting.

SUMMARY OF THE INVENTION

It is therefore an object of the invention to provide a battery operated flexible massage device.

It is also an object of the invention to provide a battery operated flexible massage device which is an improvement over conventional designs.

It is another object of the invention to provide a battery operated flexible massage device which has a relatively simple construction.

It is yet another object of the invention to provide a battery operated flexible massage device which is not subject to fatigue which would cause it to break.

In accord with these objects which will be discussed in detail below, a battery operated flexible massage device according to the invention includes a ball-and-socket modular plastic spine and an electric vibrator unit, all covered by a flexible foam tube. The tube containing the spine and the vibrator unit is covered with a padded fabric cylindrical shell. The ends of the shell are provided with zippers which allow access to battery compartments. According to the presently preferred embodiment, the vibrator unit is centrally located with the flexible plastic spine extending along side the vibrator unit but not actually coupled to it. Two battery compartments are provided, one at each end of the tube, each for containing two AA batteries. A control switch is mounted adjacent to one of the battery compartments. The control switch may be provided with circuitry for selecting multiple speeds of vibration. The ball and socket spine allows the tube and shell to be held in a folded configuration selected by the user.

Additional objects and advantages of the invention will become apparent to those skilled in the art upon reference to the detailed description taken in conjunction with the provided figures.

DETAILED DESCRIPTION OF THE PREFERRED EMBODIMENT

Figure 1:
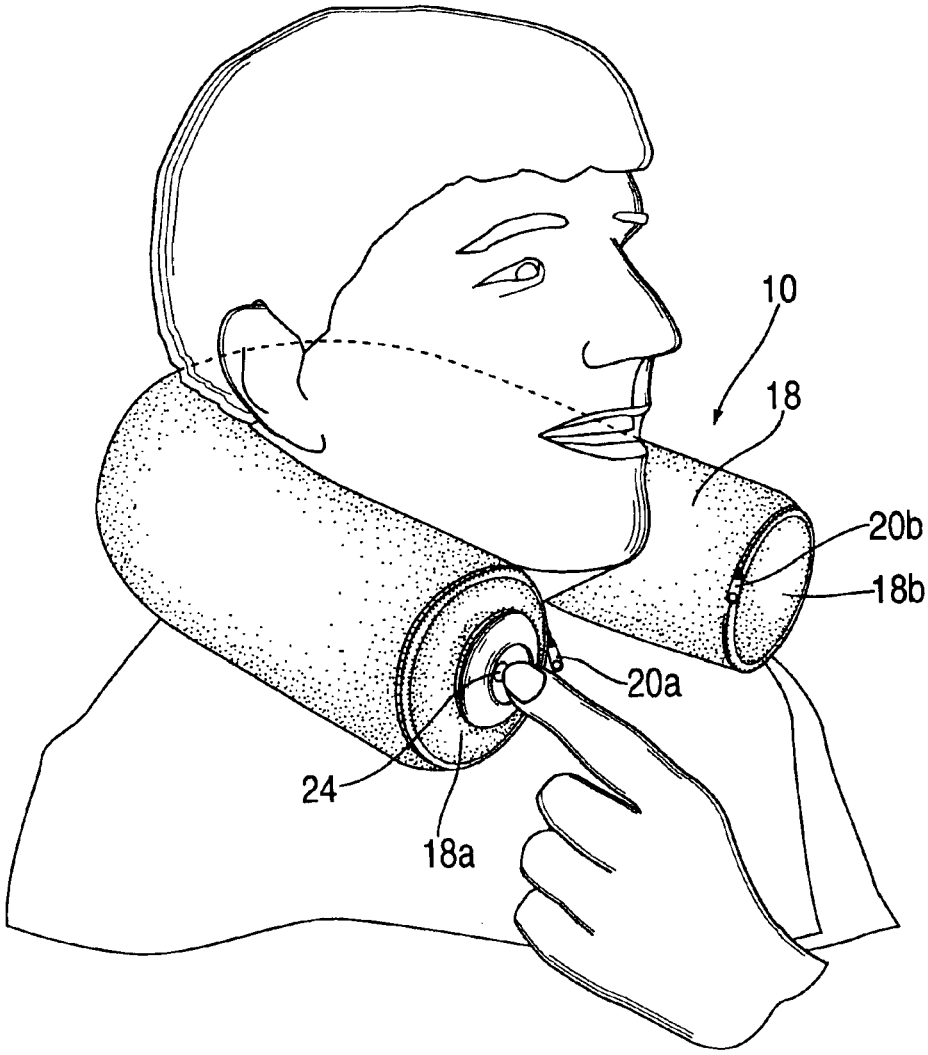
FIG. 1 is a perspective view of a battery operated flexible massage tube according to the invention, shown wrapped around a user's neck.

Turning now to FIGS. 1–4, a battery operated flexible massage device 10 according to the invention includes a ball-and-socket modular plastic spine generally designated by reference numeral 12. Spine 12 is received within an optional, flexible, inner cylindrical plastic foam tube 15. A centrally located electric vibrator unit 14 is in contact with spine 12 via its base and a cut out 17 in tube 15. A preferably plastic, flexible and compressible foam tube 16 surrounds spine 12, inner tube 15, and the vibrator unit 14 which, in turn, is covered with a preferably padded, fabric cylindrical shell 18. The ends 18*a*, 18*b* of the shell 18 are provided with zippers 20*a*, 20*b* to thereby define openable end flaps which allow access to disc-shaped battery compartments 22*a*, 22*b* having openable lids (not shown).

According to the presently preferred embodiment, the vibrator unit 14 is centrally located alongside the plastic spine 12 which conducts vibration from the vibrator unit even though it is not actually coupled to the vibrator unit. This arrangement simplifies manufacture. However, it is within the scope of the invention to have the spine 12 and vibrator unit 14 physically coupled to each other. It is also possible to have two spines, each extending from opposite sides of the vibrator unit. For purposes of the invention, it is necessary that the vibrator unit "communicate" with the spine, i.e. vibrations from the vibrator unit are transmitted along the spine.

Figure 2:
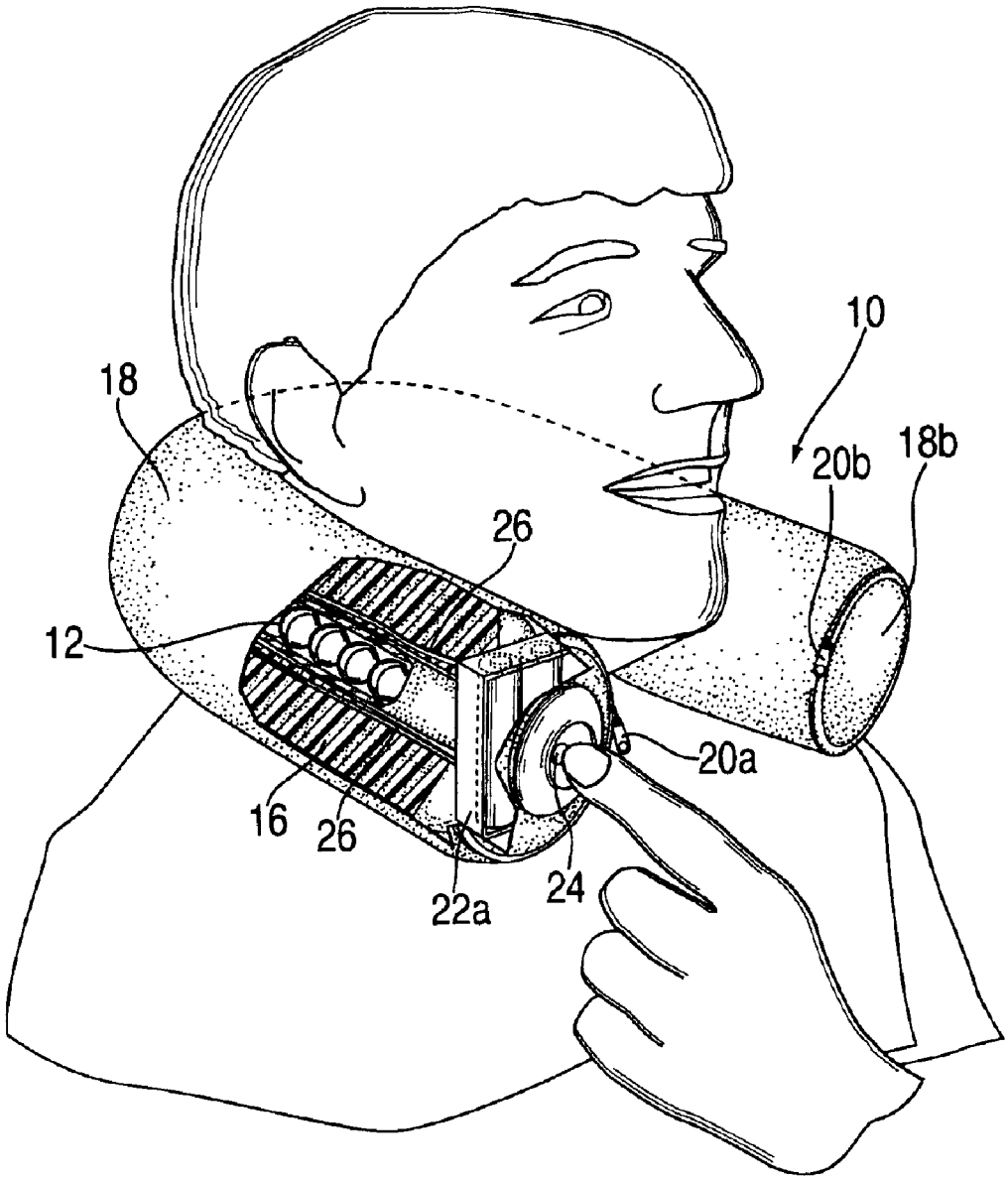
FIG. 2 is a view similar to FIG. 1 but with a portion of the tube cut away.
Figure 3:
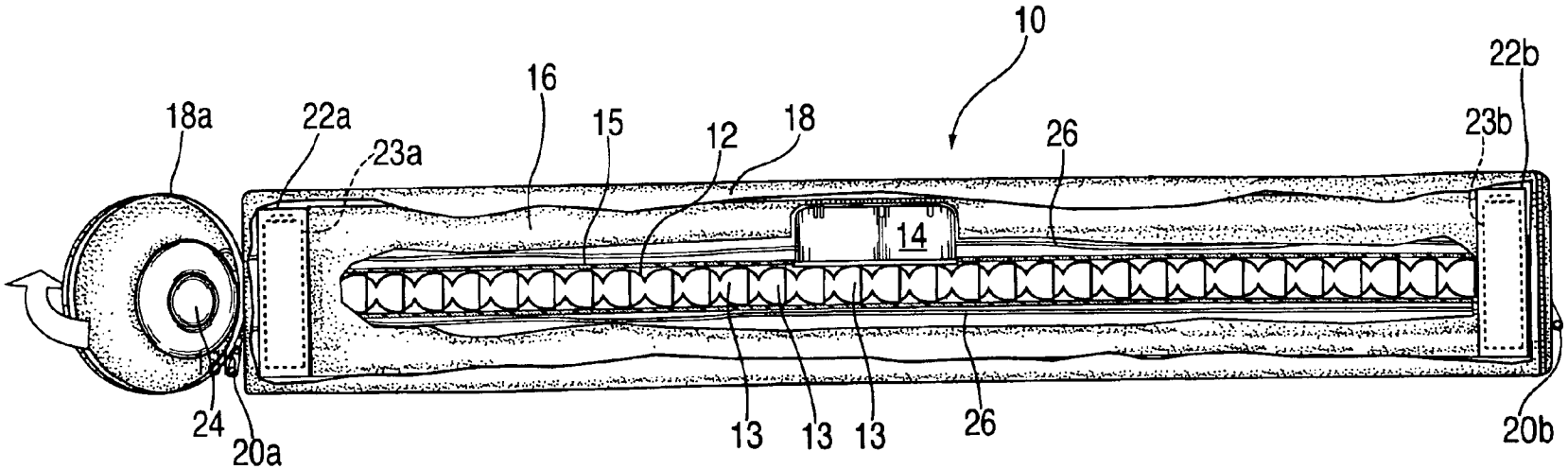
FIG. 3 is a longitudinal partially cut away view illustrating the major components of the battery operated flexible massage tube.

In the presently preferred embodiment, two battery compartments 22*a*, 22*b* are provided, one at each end of the tube, each for containing two AA batteries 23*a*, 23*b* which are shown in phantom lines in FIGS. 2 and 3. A control switch 24 is mounted adjacent to one of the battery compartments, e.g. 22*a*. The control switch 24 and the batteries 23*a*, 23*b* are electrically coupled to the vibrator unit 14 by wires shown generally as 26 in FIGS. 2 and 3. The use of two battery compartments balances the unit while allowing multiple batteries which might otherwise weigh down one end of the tube.

Most advantageously, the massage tube is approximately thirty inches long and three to four inches in diameter. It will be appreciated that the device could be made smaller or larger, however.

Figure 5A:
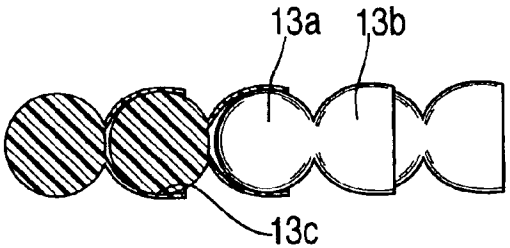
FIG. 5*a* is a side elevational view, in part section, of a portion of the modular ball and socket spine.
Figure 4:
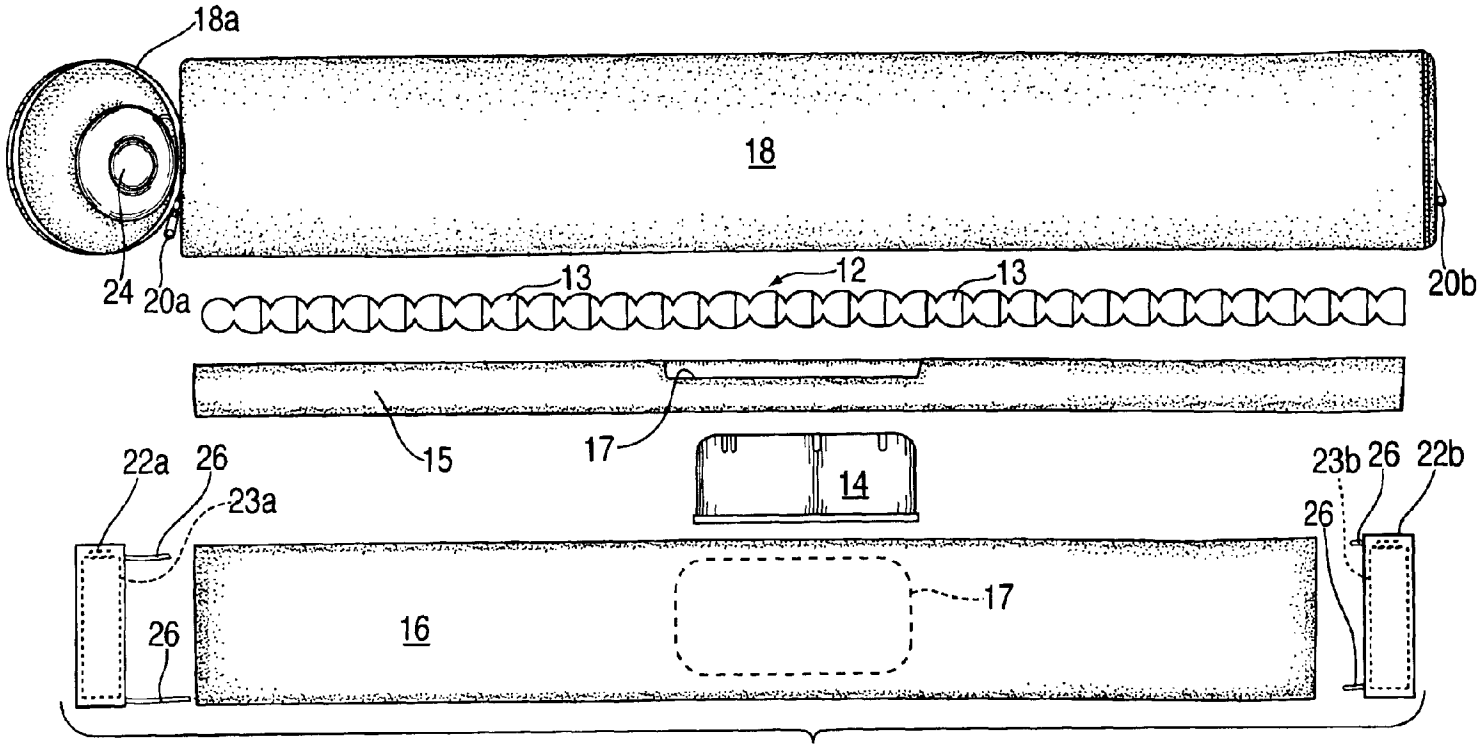
FIG. 4 is an exploded view of the components of the flexible massage tube.
Figure 5B:
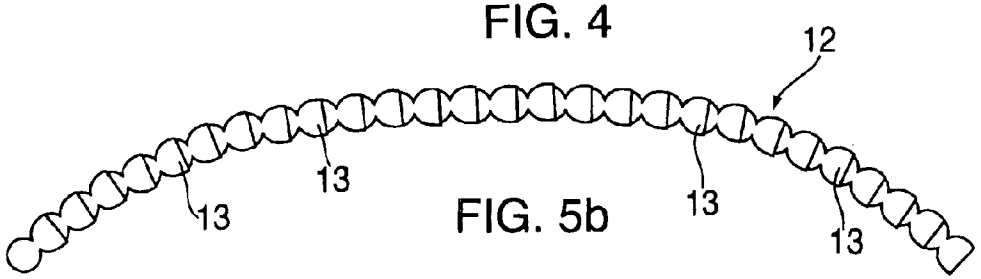
FIG. 5*b* is a side elevational view of the spine in a bended position.

Turning now to FIGS. 5*a* and 5*b*, the flexible spine 12 is made from a multiplicity of successively-arranged, relatively rigid, plastic modular units 13 which are joined to one another via a ball and socket joint. Each unit 13 has a substantially spherical ball portion 13*a* and a substantially hemispherical socket portion 13*b* which defines an interior space, e.g. 13*c* which is adapted to snugly receive a ball portion 13*a* of the adjacent unit 13. Modular spine 12 is preferably made of a relatively hard durable plastic which is not easily damaged by the friction between the ball and socket portions when the spine is articulated. It will be appreciated that spine 12 allows the tube to be held in a bent or folded configuration such as shown in FIGS. 1 and 2 or a straightened configuration such as shown in FIGS. 3 and 4, or in almost any other curved configuration (such as FIG. 5*b*). The articulated spine allows the massage tube to be self supported on the user's body such as around one's neck, knee, elbow, etc. Tube 15 in which spine 12 is encased while flexible, is relatively non-compressible or only slightly compressible to prevent the user from feeling the hard plastic spine when adjusting the massage tube, whereas tube 16 is readily compressible to provide a more comfortable fit.

Figure 6:
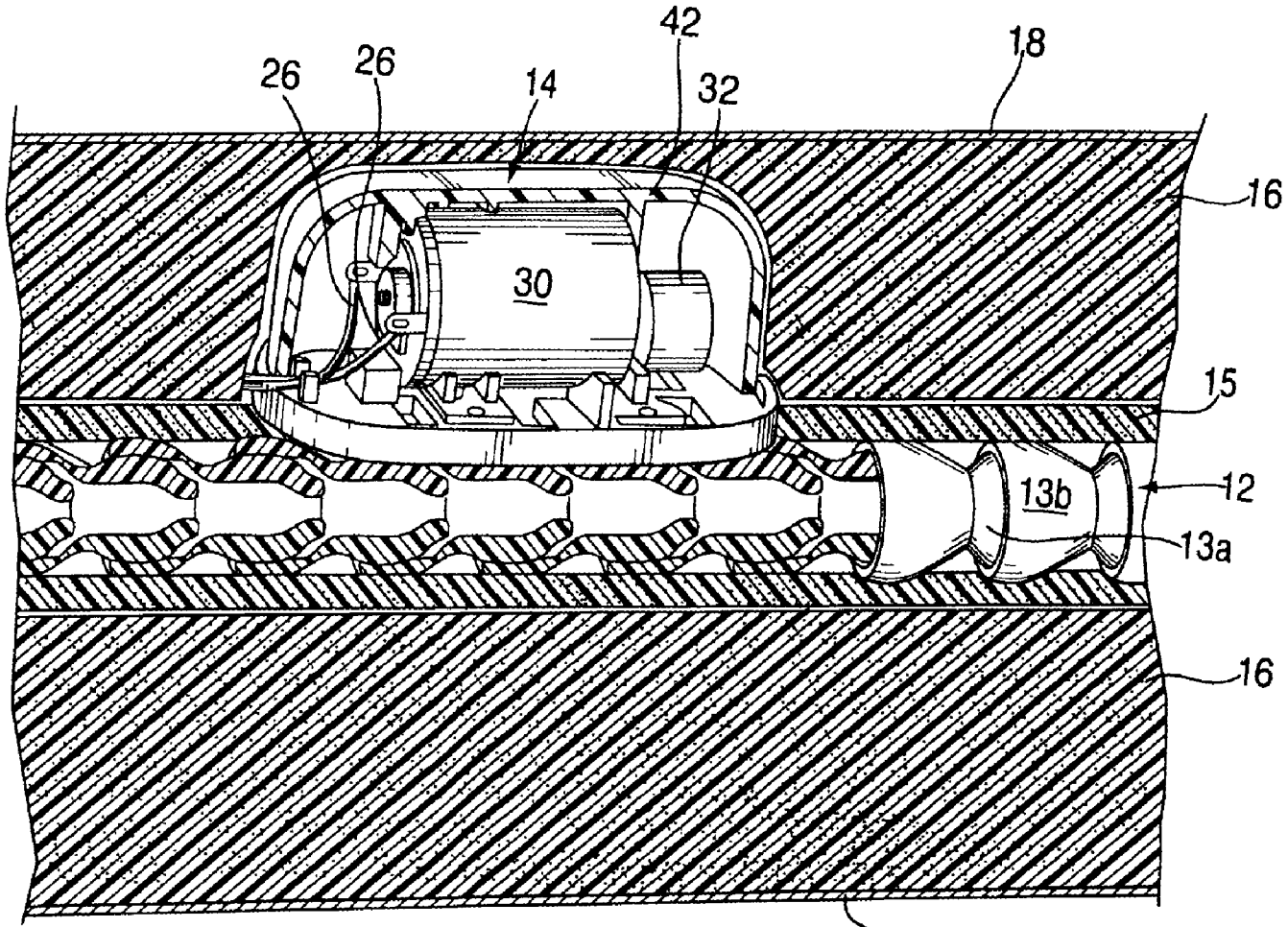
FIG. 6 is an elongated, fragmentarily illustrated sectional view, in part elevation, of the central portion of the tube.

Those skilled in the art of battery powered vibrators will appreciate what type of vibration unit 14 is appropriate for use with the invention. For example, the aforementioned U.S. Pat. No. 4,878,489 discloses a vibrator unit which could be used in the present invention. The complete disclosure of U.S. Pat. No. 4,878,489 is incorporated by reference herein for its teaching of battery operated vibrator units. More particularly, as seen best in FIG. 6, the vibration unit comprises a conventional electrical motor 30 connected by electrical wires 26 to the batteries. The electric motor has a drive shaft (not shown) on which an eccentric disc or weight 32 is mounted. As will be understood by those skilled in the art, upon rotation of the drive shaft when the electric motor is engaged, eccentric weight 32 will rotate and, due to its off center arrangement, will create a vibration which is transmitted via the base of electric motor housing 34 to spine 12. Spine 12, in turn, transmits the vibration along its entire length which, in turn, causes the entire massage unit to vibrate.

Figure 7:
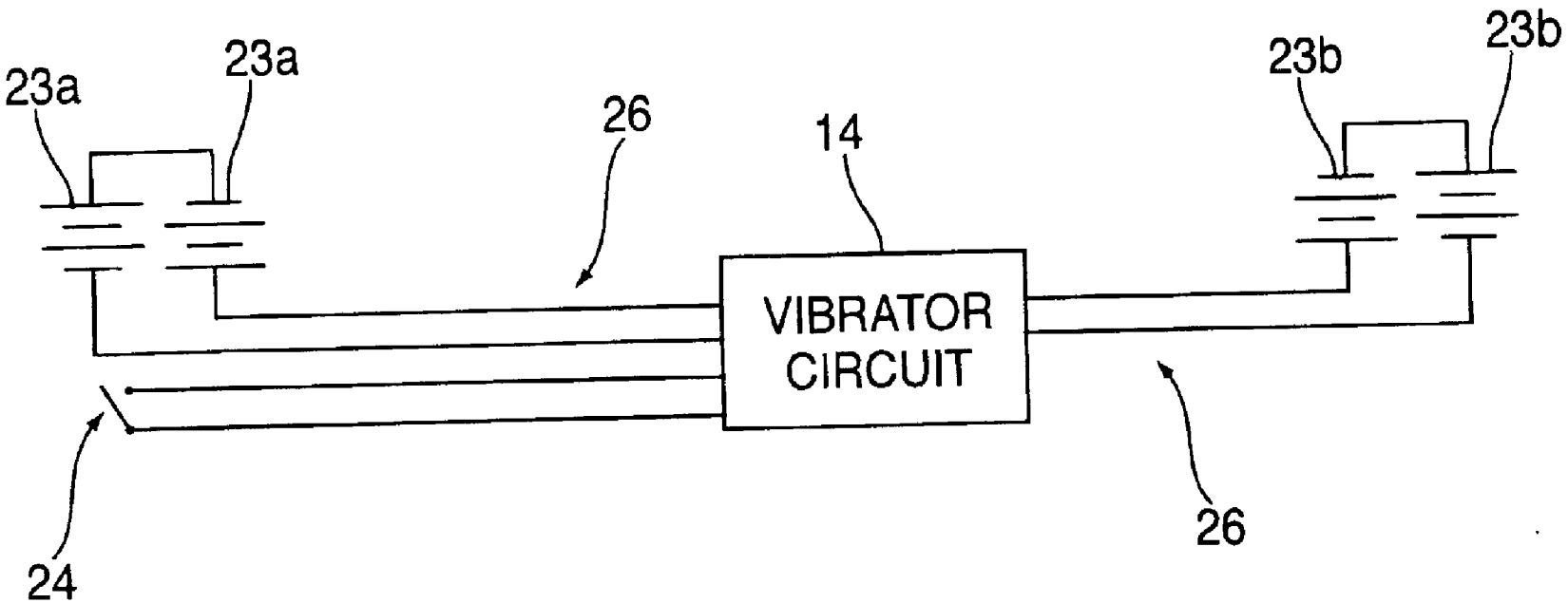
FIG. 7 is a high level schematic block diagram of a circuit for a battery operated flexible massage tube according to the invention.

FIG. 7 illustrates a schematic diagram of a circuit arrangement according to the invention. The circuit includes the vibrator unit 14 and the switch 24, as well as the wiring 26. Batteries 23*a* and 23*b* are provided by the user or may be supplied with the invention. In the presently preferred embodiment, the switch 24 is a conventional momentary on pushbutton switch and a switching circuit is provided in conjunction with the vibrator 14. The circuit may be a simple relay circuit which enables "push on, push off" operation. Alternatively, the circuit may include power regulation which permit the vibrator to operate at different speeds in response to multiple presses of the pushbutton.

There have been described and illustrated herein a battery operated flexible massage tube. While particular embodiments of the invention have been described, it is not intended that the invention be limited thereto, as it is intended that the invention be as broad in scope as the art will allow and that the specification be read likewise. For example, although an inner foam tube 15 is provided so as to prevent the user from feeling the hard plastic spine when grasping and bending the unit, it may be eliminated in certain applications where this is not a concern. In addition, while the articulation of the spine by the ball and socket arrangement is highly advantageous, articulating by other "non-wire" techniques which permit repeated handling and bending without breaking or rupture may be possible. Instead of a fabric covering, other materials (e.g. leather) could be used. Similarly, while the spine is preferably made of plastic, it could also be made of metal. It will therefore be appreciated by those skilled in the art that other modifications could be made to the provided invention without deviating from its spirit and scope as so claimed.

What is claimed is:

1. A battery operated massage device, comprising:

a) a flexible tube having a hollow interior;

b) an articulated spine extending through said hollow interior and extending along the majority of said flexible tube, and comprising a multiplicity of successively-arranged, jointed rigid elements;

c) an electric vibrator unit mounted in said hollow interior;

d) at least one battery holder; and e) an electrical switch electrically coupled to said battery holder and said electric vibrator.

2. The device according to claim 1, wherein:

said rigid elements are each joined to adjacent rigid elements by a ball and socket joint.

3. The device according to claim 1, wherein:

said articulated spine is plastic.

4. The device according to claim 1, wherein:

said articulated spine extends substantially the entire length of said flexible tube.

5. The device according to claim 1, wherein:

said at least one battery compartment includes two battery compartments, one at each end of said flexible tube.

6. The device according to claim 1 ,wherein:

said flexible tube is foam.

7. The device according to claim 6, further comprising:

f) a fabric tube covering said foam.

8. The device according to claim 7 wherein:

said at least one battery compartment includes two battery compartments, one at each end of said flexible tube, and said fabric tube is provided with two zippers, one adjacent to each battery compartment.

9. The device according to claim 1, additionally including an additional flexible tube received on said spine.

10. A battery operated flexible massage device, comprising:

a) a flexible foam tube;

b) a ball-and-socket modular plastic articulated spine extending through said tube along substantially the entire length thereof, said articulated spine comprising a multiplicity of successively-arranged, ball and socket jointed rigid elements; and c) an electric vibrator unit communicating with said spine.

11. The device according to claim 10, wherein:

said vibrator unit is centrally located relative to said spine.

12. The device according to claim 11, further comprising:

d) two battery compartments, one located at each end of said tube.

13. The device according to claim 12, further comprising:

e) a fabric outer tube covering said flexible foam tube.

14. The device according to claim 13, further comprising:

f) a pair of zippers, one located at each end of said fabric outer tube, said zippers providing access to said battery compartments.

* * * * *